US005971750A

United States Patent [19]

Ho

[11] Patent Number: 5,971,750

[45] Date of Patent: Oct. 26, 1999

[54] LIGHTER HAVING THE FUNCTION OF INDICATING

[76] Inventor: Ko Liang Ho, No. 305, Hua Cheng Rd., Hsin Chuang City, Taipei Hsien, Taiwan

[21] Appl. No.: 09/229,558

[22] Filed: Jan. 13, 1999

[51] Int. Cl.[6] ..... F23D 3/16

[52] U.S. Cl. ..... 431/253; 362/253; 362/259

[58] Field of Search ..... 431/253, 254, 431/277, 142, 129; 362/253, 259, 200, 201, 101

[56] References Cited

U.S. PATENT DOCUMENTS

| | | | |
|---|---|---|---|
| 2,075,883 | 4/1937 | Britsch | 431/253 |
| 3,711,240 | 1/1973 | Warshaw | 431/253 |
| 4,305,118 | 12/1981 | Paquette | 362/253 |
| 4,816,971 | 3/1989 | Chin | 362/253 |
| 5,697,700 | 12/1997 | Huang | 362/259 |

*Primary Examiner*—James C. Yeung
*Attorney, Agent, or Firm*—Rosenberg, Klein & Bilker

[57] ABSTRACT

A combination lighter and optical pointer assembly is provided. The assembly generally comprises a body, a lighter unit, and an optical pointer unit. The body has formed therein first and second compartments, the lighter unit being received in the first compartment, and the optical pointer unit being received in the second compartment. The optical pointer unit includes a laser device that is powered by a battery disposed in the second compartment. The assembly thereby provides fully functional and independently operable lighter and optical pointer functions.

8 Claims, 3 Drawing Sheets

LIGHTER HAVING THE FUNCTION OF INDICATING

BACKGROUND OF THE INVENTION

1. Field of the Invention

The present invention relates to a lighter unit combined with the function of an indicating unit, and in particular, to a device combining both functional units.

2. Background of the Invention

Conventional lighters provide only a flame generating function. Its utility is thus limited to that sole function. However, laser indicators, or pointers, have found wide use in presentations. A presenter typically indicates an object on a presentation surface by emitting a laser beam. Prior art pointers are enclosed within dedicated shells, but such dedicated shells increase costs. Also, prior art laser pointers packaged in such dedicated shells tend to be small in volume. Often, a user cannot easily find a misplaced pointer.

SUMMARY OF THE INVENTION

Accordingly, the object of the present invention is to provide a lighter device also having therein a pointer function. The device comprises a body, a lighter unit, and a pointer unit. The lighter unit and the pointer unit are combined in a common package so as to make available both the functions of firing and pointing, and, thereby yield a device having wide application. In accordance with the present invention, the pointer unit is installed within the body, sharing the body (shell) with the lighter unit. Thus, a dedicated shell for one of the units becomes unnecessary, and the costs are reduced accordingly. Given that a lighter unit typically possesses a relatively large volume, it has available ample volume to accommodate a pointer unit without effect on its function or use. A laser pointer unit is thus conveniently combined with a portable lighter unit so as to make both functions readily available for use.

BRIEF DESCRIPTION OF THE DRAWINGS

The present invention will be better understood and its numerous objects and advantages will become apparent to those skilled in the art by referencing the following Drawings in which.

DETAILED DESCRIPTION OF THE PREFERRED EMBODIMENTS

Figure 1:
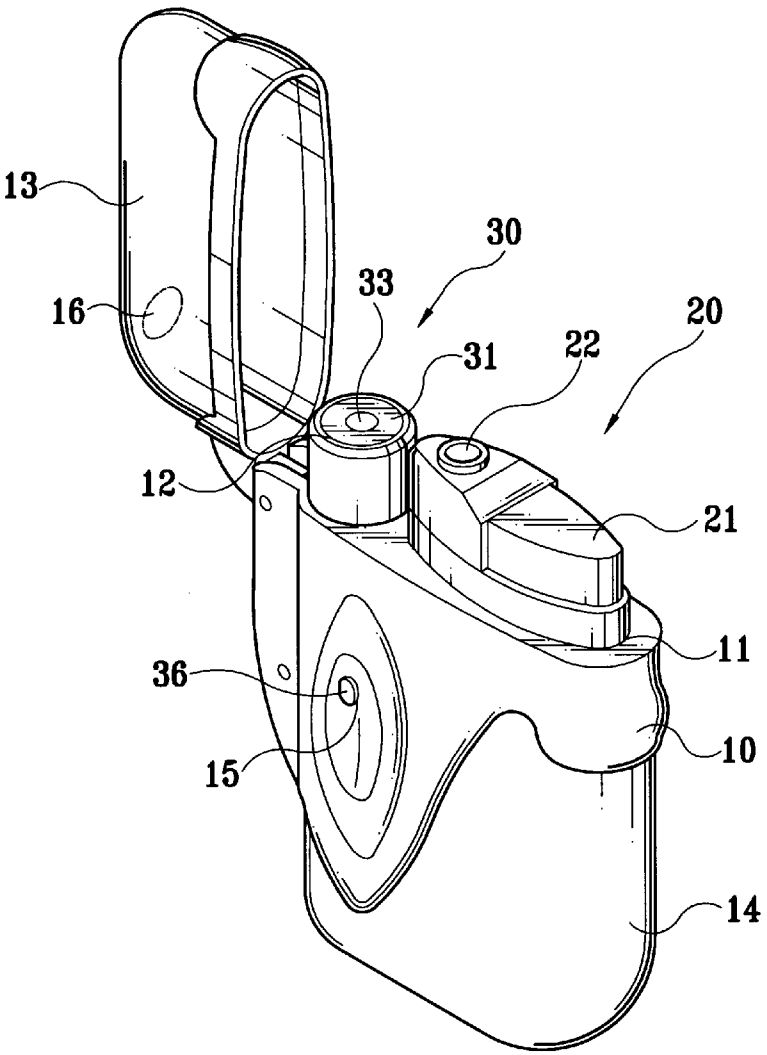
FIG. 1 is a perspective view of one embodiment of the present invention.
Figure 2:
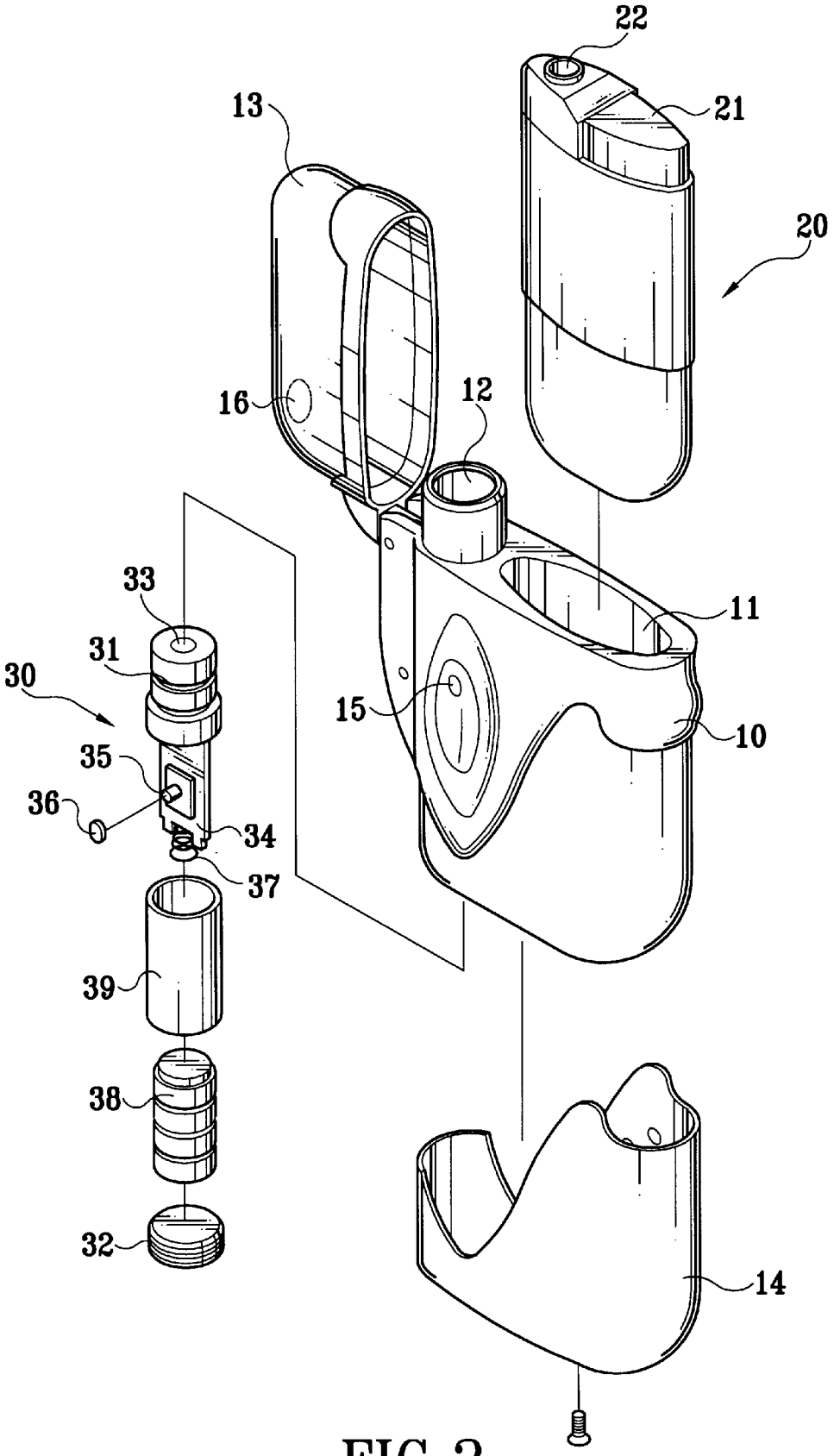
FIG. 2 is an exploded perspective view of one embodiment of the present invention; and, FIG. 3 is a sectional view of one embodiment of the present invention.
Figure 3:
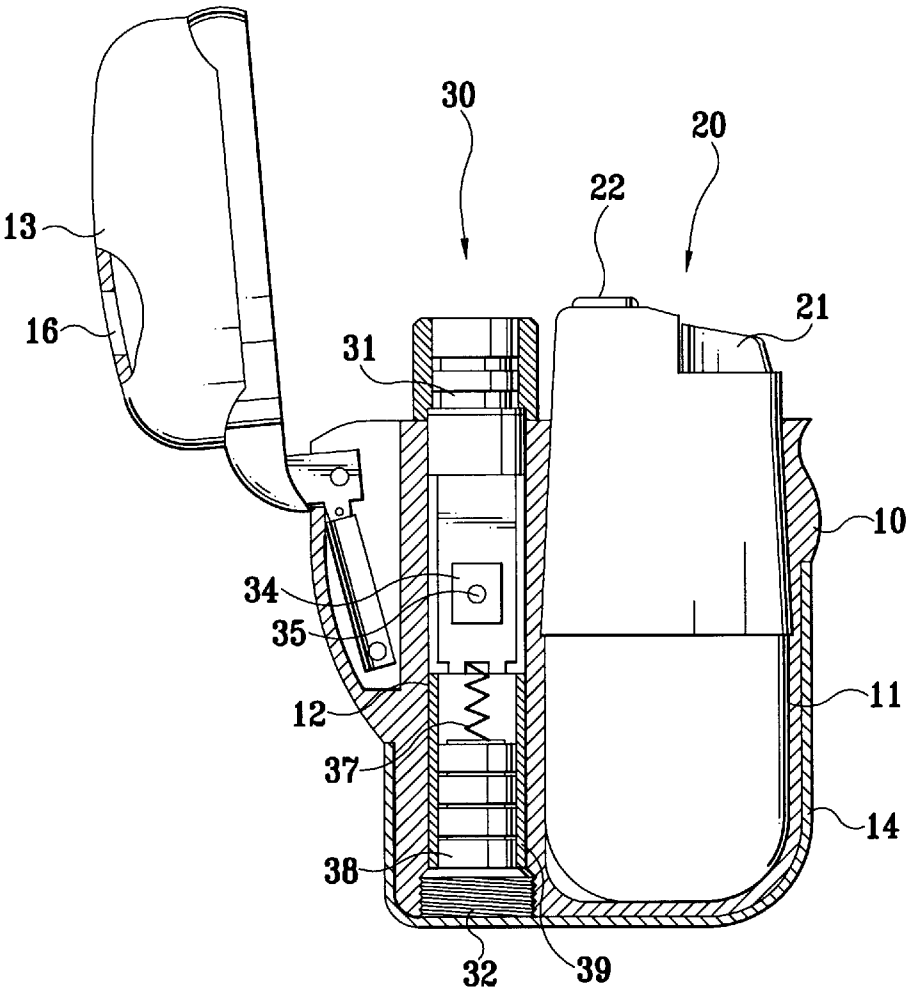

As shown in FIGS. 1, 2, and 3, a lighter with an indicator, or pointer, is illustrated. The lighter includes a body 10, a lighter unit 20, and a pointer unit 30. The body 10 is formed with a first compartment 11 and a second compartment 12. The upper end of the body 10 has pivotally coupled thereto an upper cover 13 which can be opened or closed to cover the upper end of the body 10. A light outlet 16 is formed through the upper cover 13. The upper end of the first compartment 11 is formed with an opening. The lower and upper ends of the second compartment 12 are formed with openings. The lower half portion of the body 10 may be covered by a body cover 14 for aesthetic enhancement. An opening 15 is formed on the body 10.

The lighter unit 20 is formed by any suitable lighter device. Fuel is contained within the lighter unit 20. The upper end of the lighter unit 20 is provided with a firing switch 21 and a firing mouth 22. The fuel is ignited by pressing the firing switch 21, and the resulting flame is generated through the firing mouth 22. Since the lighter unit 20 is a prior art lighter, and not within the scope of the present invention, it will not be described in further detail herein.

The lighter unit 20 is mounted within the first chamber 11 of the body 10 with suitable tightness. The firing switch 21 of the lighter unit 20 and the firing mouth 22 are disposed to protrude from the upper end of the body 10.

The indicator, or pointer, unit 30 employs a laser device 31 and a bottom cover 32. A suitable laser diode known in the art (not shown) is mounted within the laser device 31. The laser device 31 has a light outlet 33 for laser light emission therethrough. A circuit board 34 is connected at the lower end of the laser device 31 and is coupled to a touch controlled switch 35 engaged by a press cap 36. The laser device 31 of the pointer unit 30 is disposed within the second chamber 12 of the body 10. The touch controlled switch 35 is disposed for access through the opening 15 of the body 10 with the pressing cap 36 aligned with the opening 15 of the body 10 so that it protrudes slightly from the body 10. A spring 37 is connected to the lower end of the circuit board 34. A sleeve 39 is connected to the lower end of the circuit board within the second chamber 12; and, a battery 38 is contained within the sleeve 39. The lower end of the spring 37 contacts the battery 38 to conduct the power provided by the battery to the circuit board 34 and the laser device 31. The bottom cover 32 releasable plugs the lower end of the second compartment 12 by, preferably, a threaded coupling to permit convenient replacement of the battery.

In utilizing the pointer unit 30 of the present invention, the upper cover 13 may be open and the press cap 36 depressed to actuate the touch controlled switch 35. Laser light is then generated and emitted through the light outlet 33 of the laser device 31. If the upper cover 13 is closed, the laser light may be so generated, but emitted through the light outlet 16 of the upper cover 13. In accordance with the present invention, the lighter unit 20 and the pointer unit 30 are thus combined within a common body, so that both the pointer and lighter functions are fully provided.

The pointer unit 30 shares the body (shell) 10 with the lighter unit 20 in this manner. Thus, a separate shell for the pointer unit 30 is unnecessary, and costs are reduced. Whereas the body 10 of a lighter typically possesses ample unused volume, it may be formed in accordance with the present invention to accommodate the pointer unit 30 without affecting the function and use of the lighter. Also, a predetermined gap is present between the firing mouth 22 of the lighter unit 20 and the laser device 31 of the pointer unit 30. This prevents heat generated when the firing mouth emits a flame from harming the laser device 31. In accordance with the present invention, therefore, a laser indicator is conveniently combined with a portable lighter so that both functions will remain readily accessible to the user.

Whereas prior art lighters only provide a single dedicated function, the device of the present invention provides a lighter-laser indicator combination that overcomes numerous disadvantages inherent in such prior art.

Although the invention has been described in detail with reference only to a preferred embodiment, those skilled in the art will appreciate that various modifications can be made without departing from the spirit or scope of the invention as defined by the following claims which are intended to embrace all equivalents thereof.

What is claimed is:

1. A combination lighter and optical pointer assembly comprising:

(a) a body having formed therein first and second compartments;

(b) a lighter unit received in said first compartment of said body for generating a lighter flame;

(c) an optical pointer unit received in said second compartment of said body, said optical pointing unit including a laser device for generating an optical beam;

(d) a battery received in said second compartment for powering said optical pointer unit; and, (e) an upper cover coupled to said body, said upper cover having formed therein an outlet opening adapted for the passage of said optical beam therethrough.

2. A combination lighter and optical pointer assembly comprising:

(a) a body having formed therein first and second compartments;

(b) an upper cover coupled to said body, said upper cover being displaceable between open and closed positions;

(c) a lighter unit received in said first compartment of said body, said lighter unit being operable to generate a lighter flame when said upper cover is in said closed position;

(d) an optical pointer unit received in said second compartment of said body, said optical pointer unit including a laser device for generating an optical beam, said optical pointer unit being operable independent of said lighter unit operability.

3. The combination lighter and optical pointer assembly as recited in claim 2 further comprising a battery received in said second compartment for powering said optical pointer unit.

4. The combination lighter and optical pointer assembly as recited in claim 2 wherein said upper cover has formed therein an outlet opening adapted for the passage of said optical beam therethrough.

5. The combination lighter and optical pointer assembly as recited in claim 2 further comprising a body cover engaging at least a portion of said body.

6. The combination lighter and optical pointer assembly as recited in claim 2 wherein said optical pointer unit further includes:

(a) a circuit board coupled to said laser device; and, (b) a switch coupled to said circuit board, said switch having a manually displaceable cap for the selective actuation thereof, said cap protruding through said body.

7. The combination lighter and optical pointer assembly as recited in claim 3 wherein said battery is disposed within a sleeve received in said second chamber of said body.

8. The combination lighter and optical pointer assembly as recited in claim 3 wherein said body has formed therein a releasable plugged access opening communicating with said second compartment, said access opening being adapted for the passage of said battery therethrough.

* * * * *